US005530981A

United States Patent [19]

Chen

[11] Patent Number: 5,530,981

[45] Date of Patent: Jul. 2, 1996

[54] TOOTHBRUSH HAVING A TONGUE SCRAPER DISPOSED THEREIN

[76] Inventor: Wen-sqn Chen, No. 54, Nanmei St., Taichung, Taiwan

[21] Appl. No.: 427,204

[22] Filed: Apr. 24, 1995

[51] Int. Cl.[6] ..... A47L 13/12

[52] U.S. Cl. ..... 15/111; 15/167.1; 15/172; 15/144.1; 606/161

[58] Field of Search ..... 15/172, 144.1, 15/167.1, 167.2, 171, 184, 785, 111, 110, 112, 113; 606/161

[56] References Cited

U.S. PATENT DOCUMENTS

| | | | |
|---|---|---|---|
| D. 243,422 | 2/1977 | Varga | D4/2 |
| D. 295,695 | 5/1988 | Golzari | D4/105 |
| D. 309,528 | 7/1990 | Valenti | D4/104 |
| D. 332,352 | 1/1993 | Caldwell et al. | D4/104 |
| D. 345,055 | 3/1994 | Boodram | D4/104 |
| 1,092,014 | 3/1914 | Briggs | 15/172 |
| 2,609,251 | 9/1952 | Haupt | 15/172 |
| 3,868,742 | 3/1975 | Brenner | 15/172 |
| 3,886,618 | 6/1975 | Pooletti | 15/172 |
| 4,079,478 | 3/1978 | Andrews, Sr. | 15/210 R |
| 5,005,246 | 4/1991 | Yen-Hui | 15/111 |
| 5,177,827 | 1/1993 | Ellison | 15/22.1 |
| 5,331,704 | 7/1994 | Rosen et al. | 15/106 |

*Primary Examiner*—Gary K. Graham
*Attorney, Agent, or Firm*—Peterson, Wicks, Nemer & Kamrath

[57] ABSTRACT

A toothbrush having a scraper disposed therein includes a handle and a bristle portion which has a barrel connected therewith and is pivotally engaged to the handle with a cylinder disposed to the barrel pivotally engaged between two ears extending from an end of the handle, the handle having a groove defined in a side thereof for the scraper to be inserted therein, each of the ears having a first recess defined therein and the cylinder having a plurality of short grooves defined in both ends thereof, the scraper having a first end and having two parts extending therefrom for insertion into said short grooves, a hook portion formed to one of the parts laterally and engaged with the first recess of the ear, the scraper having a T-shaped plate slidably received in the groove of the handle.

2 Claims, 2 Drawing Sheets

TOOTHBRUSH HAVING A TONGUE SCRAPER DISPOSED THEREIN

BACKGROUND OF THE INVENTION

The present invention relates to a toothbrush in which a scraper is disengageably disposed therein.

Generally, a toothbrush has a bristle portion and a handle, whereby a user holds the handle to clean his/her teeth by moving the bristle on the teeth such that remains of food adhered between the adjacent teeth will be removed. Such a toothbrush has only one function which is to clean the user's teeth, however, some people further use a scraper to scrape their tongue so as to clear tiny remains adhered on the tongue to prevent bad smell from being produced by the remains on the tongue, however, the scraper and the toothbrush have to be carried by the user separately.

The present invention intends to provide an improved toothbrush which has a scraper disposed therein so as to mitigate and/or obviate the above-mentioned problems.

SUMMARY OF THE INVENTION

The present invention provides a toothbrush having a scraper disposed therein, the toothbrush includes a handle and a bristle portion which has a barrel connected therewith and is pivotally engaged to the handle with a cylinder disposed to the barrel pivotally engaged between two ears extending from an end of the handle, the handle having a groove defined in a side thereof for the scraper to be inserted therein, each of the ears having a first recess defined therein and the cylinder having a plurality of short grooves defined in both ends thereof, the scraper having a first end and having two parts extending therefrom for insertion into said short grooves, a hook portion formed to one of the parts laterally and engaged with the first recess of the ear, the scraper having a T-shaped plate slidably received in the groove of the handle.

It is an object of the present invention to provide a toothbrush in which a scraper is disposed so as to have an advantage of convenience for carrying.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
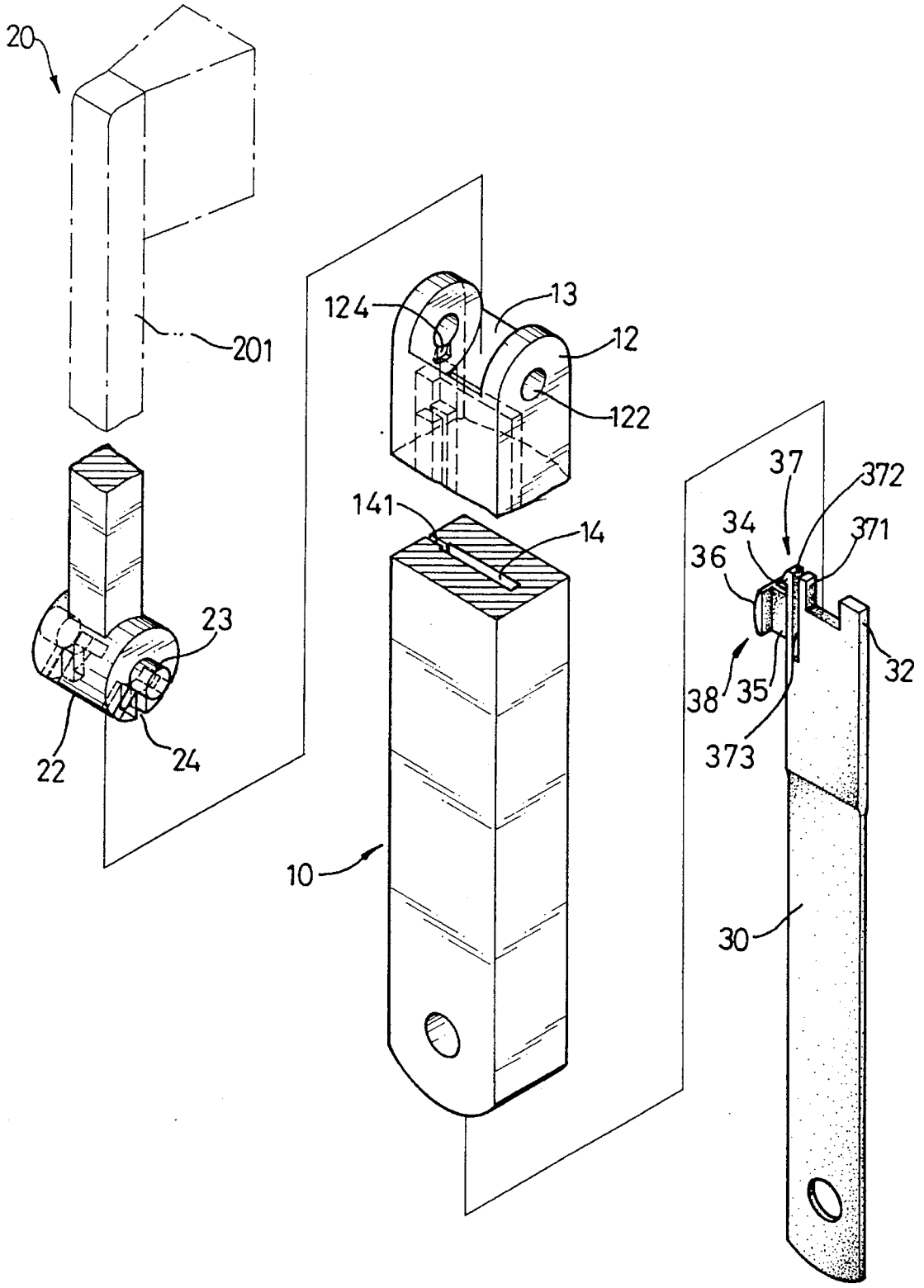
FIG. 1 is an exploded view of the toothbrush and the scraper in accordance with the present invention.
Figure 2:
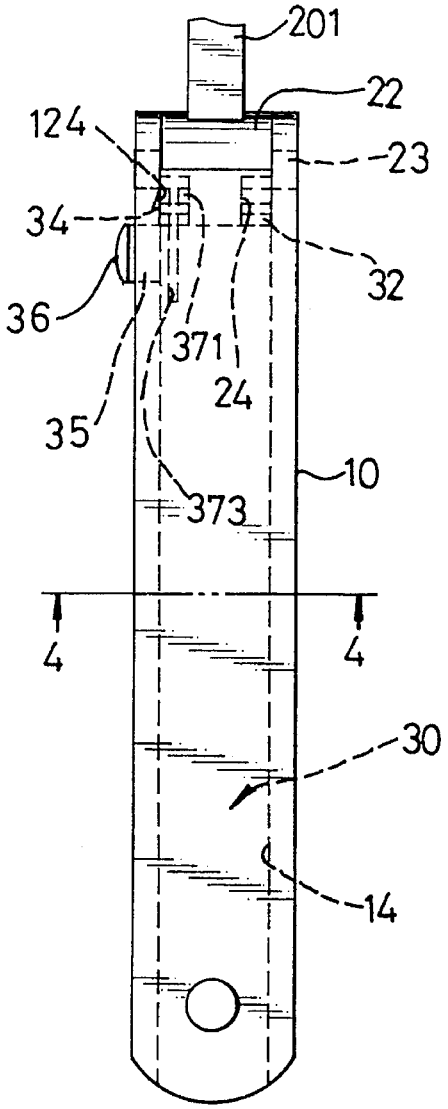
FIG. 2 is a front plane view of the engagement of the scraper disposed in the handle.
Figure 3:
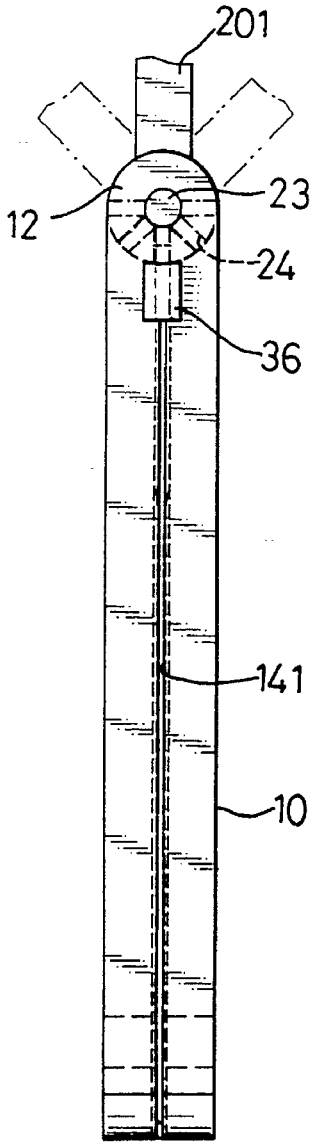
FIG. 3 is a side elevational view of the engagement of the scraper disposed in the handle.
Figure 4:
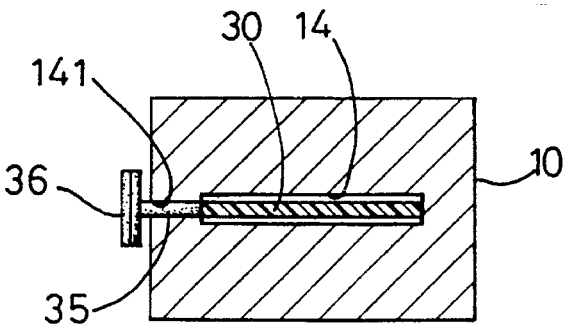
FIG. 4 is a top cross-sectional view seen along line 4—4 of FIG. 2 showing the scraper disposed in the groove of the handle.

Referring to FIGS. 1 through 4, a toothbrush in accordance with the present invention generally includes a handle 10, a bristle portion 20 and a scraper 30, the handle 10 having a first end and a second end and having a rectangular cross section, the first end thereof having two ears 12 extending separately and longitudinally therefrom, each ear

12 extending from one of two opposite sides of the handle 10 and having a hole 122 defined therein. A first recess 124 is defined in an inner surface of each of the two ears 12 and a second recess 13 is defined in the first end of the handle 10 between the two ears 12, a longitudinal groove 14 defined in one side of the handle 10, where one of the two ears 12 extend from an end of the side and the groove 14 extending through the second end of the handle 10.

The bristle portion 20 has a barrel 201 connected therewith at a first end of the barrel 201, a second end of the barrel 201 having a cylinder 22 transversely disposed thereto for pivotal insertion in the second recess 13 of the handle 10. The cylinder 22 has a stud 23 extending centrally from each of two ends thereof for engagement with the corresponding hole 122 of the ear 12 and a plurality of short grooves 24 defined in each of the two ends of the cylinder 22, each short groove 24 having its central axis passing through the central point of the cylinder 20 and extending through a periphery of the cylinder 20.

The scraper 30 is a flexible plate and has a first end and a second end, the first end thereof having a first part 37 and a second part 32 both extending separately therefrom, the first part 37 divided into a first portion 371 and a second portion 372 by a slit 373 defined therebetween, the second portion 372 has a hook portion 34 formed laterally. A T-shaped plate 38 is composed of an extending arm 35 and a pushing plate 36 wherein the extending arm 35 extends from the second portion 372 laterally. The scraper 30 is inserted in the groove 14 with the first end thereof entering the second end of the handle 10, the first portion 371 and the second portion 32 respectively inserted into the short grooves 24 defined in two ends of the cylinder 22 and the hook portion 34 engaged to the first recess 124 of the ear 12. The groove 14 has a narrower portion 141 defined in and extending through the handle 10 laterally for the extending plate 35 of the T-shaped plate 38 to be slidably inserted therein such that the pushing portion 36 of the scraper 30 is disposed to an outer surface of the side of the handle 10.

When in use, a user pushes the pushing plate 36 to disengage the hook portion 34 from the first recess 124 of the ear 12 and then slides the scraper 30 out the handle via the groove 14. In addition, when the first part 37 and the second part 32 of the scraper 30 are removed from the short grooves 24, the barrel 201 is able to be rotated about an axis of the cylinder 22 to a desired angle corresponding to a longitudinal axis of the handle 10, wherein one of the short grooves 24 is in alignment with the first recess 124 of the ear 12, and then the first part 37 and the second part 32 are inserted into the short grooves 24 in alignment with the first recess 126 to position the barrel 201, such that, the bristle portion 20 can be adjusted to a desired angle corresponding to the handle 10.

Accordingly, the scraper 30 is received in the handle 10 of the toothbrush and has an advantage of carrying conveniently the toothbrush and the scraper 30.

Although the invention has been explained in relation to its preferred embodiment, it is to be understood that many other possible modifications and variations can be made without departing from the spirit and scope of the invention as hereinafter claimed.

I claim:

1. A toothbrush having a scraper disposed therein, said toothbrush comprising a bristle portion and a handle;

said handle having a first end and a second end, said first end thereof having two ears extending longitudinally from two opposite sides thereof, each ear extending from one of said two opposite sides of said handle and having a hole defined therein, a first recess defined in an inner surface of each of said two ears, a second recess defined in said first end of said handle between said two ears, a longitudinal groove defined in one in one of said two opposite sides of said handle and said longitudinal groove longitudinally extending through said handle to an opening at said second end of said handle;

said bristle portion comprising an elongated barrel having bristles attached at one end and a transversely oriented cylinder attached at the other end of said barrel, said cylinder defining a longitudinal axis, said cylinder being inserted into said second recess, said cylinder having two ends and a stud extending centrally from each of two ends thereof for engagement with said corresponding hole of said ear and a plurality of short grooves defined in each of said two ends of said cylinder, each of said short grooves having a central axis passing through said longitudinal axis of said cylinder and extending through a periphery of said cylinder, and said scraper being a flexible and elongated plate and having a first end and a second end, said first end thereof having a first part and a second part both extending longitudinally from two opposite sides thereof, said first pate divided into a first portion and a second portion by a slit longitudinally defined therebetween, said second portion having a hook portion and a T-shaped plate extending laterally therefrom, said scraper inserted in said longitudinal groove with said first end thereof entering said second end of said handle, and first part and said second part each respectively inserted into one of said short grooves defined in said two ends of said cylinder and said hook portion being engaged with one of said first recesses.

2. The toothbrush as claimed in claim 1 wherein said longitudinal groove comprises a narrowed portion which extends through said handle for said T-shaped plate to be slidably inserted therein.

* * * * *